United States Patent [19]

Hattersley, Jr.

[11] 4,012,005

[45] Mar. 15, 1977

[54] ROTATIONAL TAPE ACCUMULATOR

[75] Inventor: Harold J. Hattersley, Jr., Bricktown, N.J.

[73] Assignee: General Cable Corporation, Greenwich, Conn.

[22] Filed: Mar. 11, 1976

[21] Appl. No.: 665,795

[52] U.S. Cl. ..... 242/55; 242/55.19 R

[51] Int. Cl.[2] ..... B65H 17/02; B65H 17/48

[58] Field of Search ..... 242/55, 55.19 R, 78.1

[56] References Cited

UNITED STATES PATENTS

| | | | |
|---|---|---|---|
| 2,318,316 | 5/1943 | Lawrence | 242/55.19 R X |
| 3,273,814 | 9/1966 | Prusak | 242/55 |
| 3,782,662 | 1/1974 | Miller | 242/55 |
| 3,888,430 | 6/1975 | Costello | 242/55 |

*Primary Examiner*—Edward J. McCarthy
*Attorney, Agent, or Firm*—Hopgood, Calimafde

[57] ABSTRACT

This rotational tape accumulator wraps slack tape in spirals during times that the tape is being fed to a machine for making cable or other continuous product. When the trailing end of a tape must be stopped to splice on a new length, the accumulated tape is unwound from the accumulator to maintain a continuous supply. This invention forms two reels of tape spirally wound from the same length of tape with each additional layer supplied to the inside of the reel during accumulation. This arrangement stores long lengths of tape with equipment that is more compact than other forms of tape accumulators.

8 Claims, 7 Drawing Figures

ROTATIONAL TAPE ACCUMULATOR

BACKGROUND AND SUMMARY OF THE INVENTION

One of the operations in making electric cables, and various other products, is the wrapping of one or more layers of tape around the product as it moves longitudinally with continuous motion. In order to avoid interrupting the continuous longitudinal movement of the product, it is necessary to splice additional reels of tape to the trailing end of a tape which is almost all used.

In order to connect a new length of tape it is necessary to stop the movement of the trailing end of the previous reel of tape long enough to make a necessary splice. With one end of the tape stationery, the other end must be moving continously to maintain the supply of tape for wrapping on the cable or other product.

This is done by using tape accumulators which accumulate a supply of tape while there is ample tape on the supply reel; and the accumulator is capable of feeding out the accumulated tape while the trailing end of the tape remains stationery during a splicing operation.

This invention is an improved rotational tape accumulator which is of simple mechanical construction and at the same time capable of accumulating large quantities of tape in an accumulator of small size.

The preferred embodiment of the invention has angularly spaced supports over which the tape passes as it travels through the accumulator, and these supports have relative rotary movement with respect to one another in such a way as to accumulate two reels of tape within the accumulator with the accumulation supplied to each reel from the inside of the reel.

Since the convolutions of tape in each reel cannot slide over one another to change the circumference or perimeter of each accumulated reel, it is necessary to have the supports move radially inward as the number of convolutions on each accumulated reel of tape acquires more convolutions.

Other objects, advantages and features of the invention will appear as the disclosure proceeds.

BRIEF DESCRIPTION OF DRAWING

In the drawing, forming a part hereof, in which like reference characters indicate corresponding parts in all the views.

DESCRIPTION OF PREFERRED EMBODIMENT

An accumulator 10 is made with an inner frame 12 and an outer frame 14. In the preferred construction, the inner frame 12 is stationary and the outer frame 14 rotates with respect to the inner frame when the accumulator is being operated to accumulate more tape. The amount of accumulated tape does not remain constant. The tape being removed from the outer frame causes it to move with a particular angular velocity, and since there is no relative movement between the successive layers of tape the angular velocity of the inside layer is the same as that of the outside layer. Because the radius of the inside layer is less than that of the outside layer, the pay-in tape linear velocity is less than the pay-out linear velocity. This causes the entire reel of tape to reduce in diameter, but the total thickness across the layers remains constant.

Figure 1:
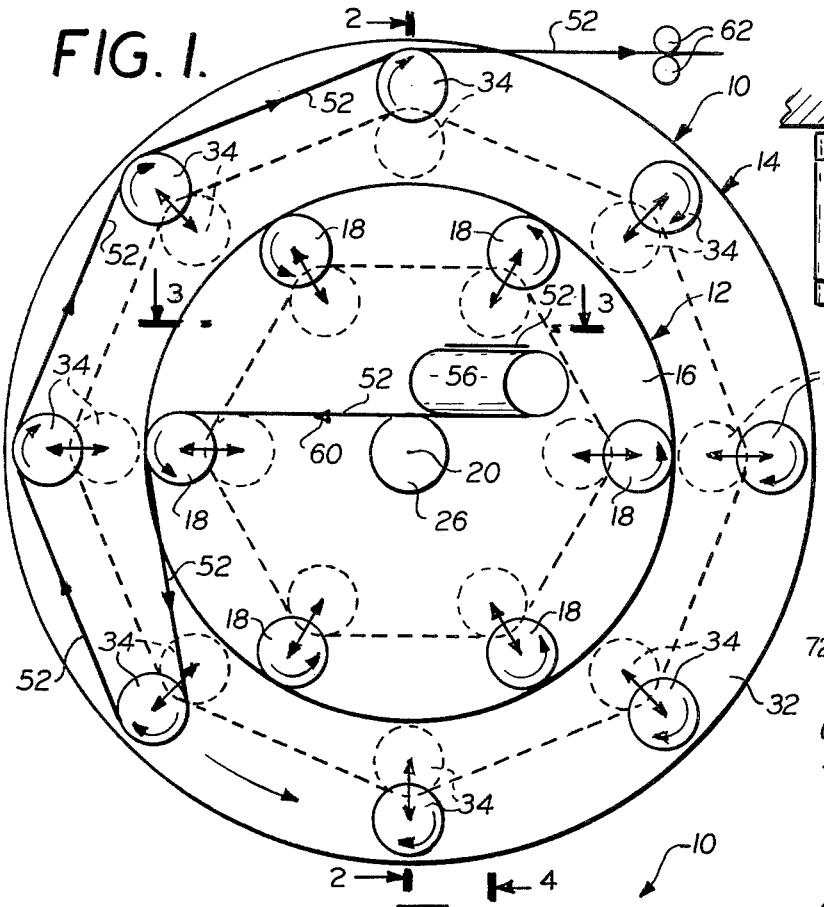
FIG. 1 is a diagrammatic view of an accumulator made in accordance with this invention.
Figure 2:
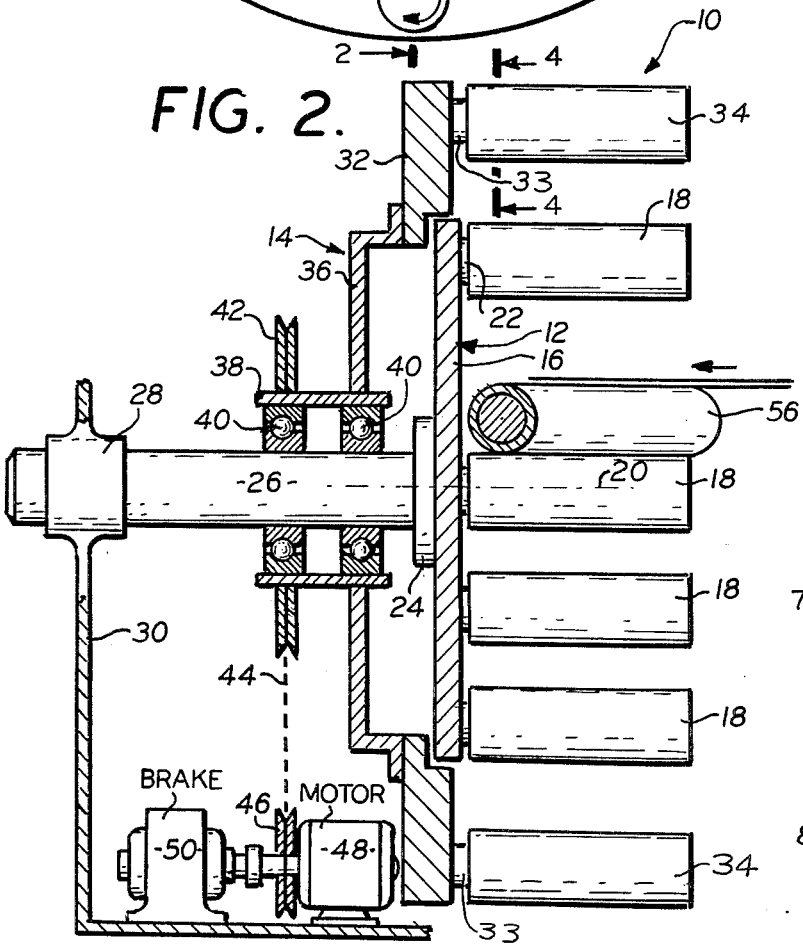
FIG. 2 is a sectional view, taken on the line 2—2 of FIG. 1.

Referring to FIG. 2, the inner frame includes a plate portion 16 which has a plurality of supporting surfaces comprising rolls 18 at angularly spaced locations around a center axis 20, as shown in FIG. 1. Each of the rolls 18 is supported by a stud shaft 22 (FIG. 2) which projects out from the plate portion 16 of the inner frame 12. These stud shafts 22 and the rolls 18 are also part of the inner frame 12.

The rolls 18 rotate on the stud shafts 22 whenever the accumulator is in use, whether it is accumulating additional tape or merely permitting tape to run through the accumulator.

The inner frame 12 has a hub 24 which supports the frame 12 from a shaft 26. This shaft is supported by hubs 28 which are part of a housing 30 of the accumulator. The shaft 26 is a stationary shaft.

The outer frame 14 has a frame portion 32 which has a plurality of rolls 34 at angularly spaced positions around the axis 20. These rolls 34 correspond to the rolls 18 of the inner frame and they are rotatably supported on stud shafts 34 which extend from the plate portion 32; but there are a greater number of rolls 34 than there are rolls 18 because of the greater circumference of the circle around which the rolls 32 are axially spaced.

Referring again to FIG. 2, the outer frame 14 has a flange 36 rigidly connected to a sleeve 38 which is coaxial with the shaft 26. This sleeve 38 is a unitary part of the frame 14 and rotates with the frame 14 on bearings 40 about the axis 20 of the shaft 26.

A pulley 42, rigidly secured to the sleeve 38, is driven by a belt 44 from a grooved pulley 46 secured to the shaft of a motor 48.

A brake 50 is connected with the motor 48 and is operated to control accurately the stopping of the accumulator as a trailing edge of a tape comes into position at a splicing station.

Figure 3:
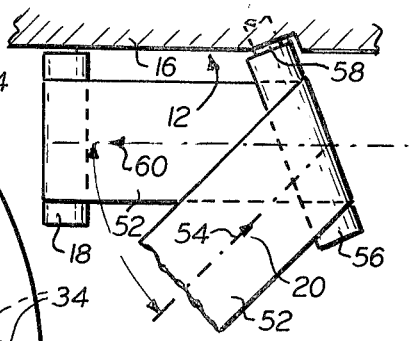
FIG. 3 is a diagrammatic view, on a reduced scale, taken on the line 3—3 of FIG. 1.

The way in which the accumulator operates is best understood from FIGS. 1 and 3. A tape 52 is supplied from a tape source (not shown) in the direction indicated by the arrow 54. This direction of supply is at an acute angle to the axis 20 of the tape accumulator. The tape 52 passes first over a cylindrical guide 56 which is carried by a stud shaft 58 projecting from the plate portion 16 of the inner frame 12. This cylindrical guide 56 does not rotate but it changes the direction of travel of the tape to that indicated by the arrow 60, and this new direction of travel is at right angles to a plane through the axis 20 about which the rolls of the outer frame have orbital movement. FIG. 3 shows the tape 52 passing around a first roll 18 of the inner frame.

Referring next to FIG. 1, the roll 18 around which the tape 52 first changes its direction is the roll 18 at the 270° position with respect to the axis 20. From this roll 18 the tape 52 passes downward and around the roll 34 which is at the 225° position with respect to the axis 20.

From this roll 34, the tape 52 passes upward, as indicated by the arrow heads along the tape 52 and passes around three other rolls 34 at the 270, 315 and 360° positions around the axis 20. The tape then leaves the accumulator at a pay-off station which includes feed rolls 62 in the illustrated embodiment of the invention. In actual practice, the feed rolls 62 may be part of the wrapping mechanism of the cable machine.

It should be understood that the rolls 18 remain in the angular positions as shown in FIG. 1 during the operation of the accumulator; but the rolls 34 travel with the outer frame 14 when the frame 14 is rotated counter clockwise to accumulate tape. The individual rolls 34 of the outer frame 14 rotate in a clockwise direction as tape moves over them. The rolls 18 of the inner frame 12 rotate in a counter clockwise direction as tape moves over them. This difference in rotation results from the geometry of the accumulator and will be more thoroughly understood as the description of the operation of the accumulator proceeds.

With the parts in the position shown in FIG. 1 there is no tape accumulated in the accumulator but it will be understood that the feed rolls 62 can pull tape through the accumulator with the outer frame 14 stationery and the tape 52 traveling along the course which has already been described. In order to accumulate tape, the outer frame 14 must rotate in a counter clockwise direction so that the roll 34, which is in the 225° position in FIG. 1, moves counter clockwise and pulls the tape with it. Since the tape 52 which extends clockwise around the other rollers 34 in FIG. 1 cannot move with the roller 34 about which the tape reverses its direction of travel, such counter clockwise, orbital movement of that roller will pull tape around the roll 18 which is at the 270° position and will continue to pull tape around this roller 18 as the roll 34, about which the tape reverses its direction of travel (hereinafter referred to as the tape reversing roller) moves counter clockwise and reaches the top position in FIG. 1.

As the tape reversing roller 34 brings tape into contact with the tape which is passing to the pay-off station, the tape reversing roller will move tape under the tape that is feeding to the pay-off station and as counter clockwise movement continues will lay a convolution of tape under the convolution which is now resting on all of the rolls 34 around 360° of the outer frame.

As the outer frame 14 continues to rotate counter clockwise, all of the rolls 34 move as a unit and the rolling of the tape across them rotates them in a clockwise direction as indicated by the arrows on the rolls. Each time that the tape reversing roller 34 reaches the top position where the tape departs from the accumulator in its movement to the pay-off station, the tape reversing roller 34 starts a new layer or convolution of tape on the inside of the convolutions already supported by the rolls 34.

A reel of successive convolutions, in a spiral around the rolls 34 builds up the radial thickness of the accumulated tape and provision is made so that the rolls 34 can move radially inward to accommodate this decrease in the inside diameter of the reel of accumulated tape. The way in which these rolls 34 move inward will be described in connection with FIGS. 4–7 but before considering those figures some explanation should be given on the accumulation of a second reel of tape accumulated on the rolls 18 of the inner frame 12.

Since the roll 18 at the 270° position does not move orbitally, it will be apparent that the counter clockwise orbital movement of the tape reversing roll 34 will wrap tape 52 around the inner frame and into contact with the other rolls 18 of the inner frame 12.

When the tape reversing roll 34 has moved far enough to wrap a complete convolution of tape around all of the rolls 18 of the inner frame, it will then make another counter clockwise orbital revolution during which the tape already on the rolls 18 will move in the direction of its length around the inner frame 12 and cause more tape to be pulled on to the inner frame from the guide 56 and around the roll 18 at the 270° position. Thus as the tape reversing roll 34 keeps rotating around the inner frame 12 it pulls the accumulated tape on the inner frame in a counterclockwise direction and keeps all of the rolls 18 rotating counter clockwise while additional tape from the guide 56 forms successive convolutions of tape on the inner surface of the tape which accumulates on the inner frame 12.

It will be understood that when the accumulator is in use supplying tape to a cable wrapping machine, the tape 52 is in continuous motion from the pay-off station and the outer frame 14 has to move the tape reversing roll 34 along its orbital path at a rate which will cause tape to be pulled into the accumulator from the guide 56 faster than it is being withdrawn from the accumulator at the pay-off station 62. Tape must be accumulated fast enough so that when the trailing end of the tape approaches a splicing station, the accumulator will have enough tape stored in it to provide the tape needed at the pay-off station for the length of time that is required to splice a new length of tape to the trailing edge of the tape which is feeding through the accumulator to the cable wrapping machine.

The tape accumulator runs at fairly high speed and has substantial inertia. In order to actively control the stopping of the rotor when a predetermined footage of tape has been accumulated the brake 50 is employed. This brake may be controlled automatically by a limit switch operated by means for measuring the length of tape that has passed through the tape accumulator. Such means may count the number of revolutions of the rotating frame 14.

Figure 4:
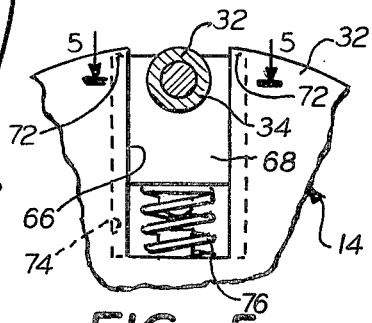
FIG. 4 is an enlarged detail view, partly in section, taken on the line 4—4 of FIG. 2.
Figure 5:
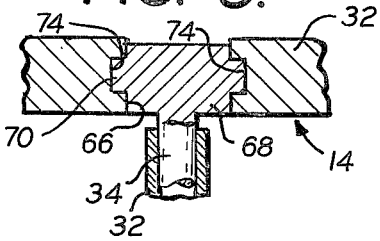
FIG. 5 is a sectional view taken on the line 5—5 of FIG. 4.

FIGS. 4 and 5 show one expedient for permitting the rolls 34 to move radially inward to accommodate the decrease in the inside diameter of the spirally wrapped reels of tape on the accumulator, and for maintaining the tape under constant tension. The plate portion 32 of the outer frame 14 has a slot 66 in which a block 68 slides. Keys 70 of the block 68 limit the movement of the block to a sliding movement lengthwise of the slot 66.

Stops 72, at the upper end of a keyway 74 in which the keys 70 slide, limit the upward movement of the block 68. A compression spring 76, confined between the bottom of the block and the slot 66 holds the block 68 up against the stops 72 when the block is not pushed down by the pressure of the tape against the roll 34.

Figure 6:
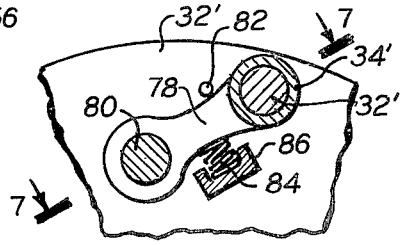
FIG. 6 is a view corresponding to FIG. 4 but showing a modified mechanical construction for urging the tape supporting rollers outward with a resilient force.
Figure 7:
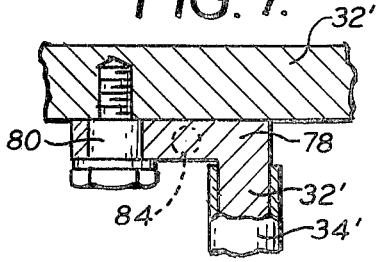
FIG. 7 is a sectional view taken on the line 7—7 of FIG. 6.

FIGS. 6 and 7 show a modified construction for resiliently holding the rolls outward in contact with the tape which accumulates within the accumulator. Parts shown in FIGS. 6 and 7 which correspond to construction shown in FIG. 4 and 5 are indicated by the same reference characters with a prime appended. A roll 34' on a stud shaft 32' is supported by a crank 78 which pivots about a stud 80 extending from the face of the plate portion 32'.

When the roll 34 is in its outermost position, the crank 78 is against a pin 82 which projects from the plate portion 32'. The crank 78 is held in contact with this pin 82 by a coil spring 84 which extends from a support 86 which is supported by and rigidly connected with the plate portion 32'.

The construction shown in FIGS. 4–7 are merely representative of movable means for holding the rolls 18 and 34 in position to maintain tension on the tape as it is wrapped around the outer frame 14 in contact with the rolls 34 which are the angularly spaced supporting surfaces for the tape on the outer frame 14. More uniform tension can be maintained on the tape by substituting a cylinder-and-piston motor for the springs 76 and 84, or by use of other more elaborate tension controls.

The preferred embodiment of the invention has been illustrated and described, but changes and modifications can be made, and some features can be used in different combinations without departing from the invention as defined in the claims.

What is claimed is:

1. A tape accumulator including in combination an inner frame and an outer frame, one of which is rotatable with respect to the other about an axis, each of the frames having a plate portion with a circle of angularly spaced shafts supported by the frame and extending therefrom generally parallel to the axis of the frame, a roll on each of the shafts rotatable with respect to its supporting frame, the rolls of each frame supporting spirally wound reels of tape in the accumulator, means for rotating one of the frames in a direction to wrape tape in spiral layers on one of the frames when said frames have relative rotation with respect to one another during which tape is accumulated by said accumulator for maintaining a continuous supply of tape to a production unit while one end of the tape is stopped for splicing an additional tape to the trailing end of the tape wound on the accumulator, at least one of the frames having means for connecting the shafts with the plate portion of the frame, and the connecting means being movable with respect to the plate in directions having components that are radial with respect to the axis of the plates whereby the rolls are movable inward toward the axis to compensate for the fact that successive layers of tape wound on the rolls are applied from the inside of the spirals of tape so that the inside radius of each spiral decreases as successive layers accumulate.

2. The tape accumulator described in claim 1 characterized by each of the frames having generally cylindrical surfaces at angularly spaced locations around the axis of the frames and on which the tape wraps during accumulation.

3. The tape accumulator described in claim 2 characterized by each of the frames having rolls angularly spaced about the axis of the frames and the surfaces of said rolls constituting the surfaces on which the tape wraps.

4. The tape accumulator described in claim 1 characterized by guide means that deliver tape from a supply source to one of the rolls of the inner frame in a direction normal to a plane through the axis of rotation of the roll, and a roll of the outer frame to which the tape travels from said one of the rolls of the inner frame and about which the tape travels through an arc of substantially 180° which changes the travel of the tape to a direction tangent to said roll of the outer frame for travel of the tape to successive angularly spaced rolls of the outer frame, and a pay-out station that leads the tape away from the rolls of the outer frame.

5. The tape accumular described in claim 4 characterized by means for rotating the outer frame with respect to the inner frame and in a direction away from the pay out station to wrap tape around the outside of the circle of rolls of the outer frame and at the same time wrap tape around the outside of the circle of rolls of the inner frame.

6. The tape accumular described in claim 5 characterized by each of the frames having means for connecting the shafts with the plate portions of the frames, and the connecting means being movable with respect to the plate in directions having components that are radial with respect to the axis of the plates whereby the rolls are movable inward toward the axis to compensate for the fact that successive layers of tape wound on the rolls are applied from the inside of the spirals of tape so that the inside radius of each spiral decreases as successive layers accumulate.

7. The tape accumulator described in claim 1 characterized by each of the shafts being supported at only one end and being a stud element extending from its supporting plate portion, a fixed structure by which the inner frame is held in a stationery position, the outer frame being located adjacent to the inner frame with the shafts extending from the plate portion of the outer frame and positioning their rolls in a circle outside an surrounding the circle of rolls of the inner frame, a bearing on which the outer frame is supported from fixed structure for rotation with respect to the fixed structure and the rolls of the inner frame, a motor for driving the outer frame, and a brake for stopping the rotation of the outer frame.

8. A tape accumulator including in combination an inner frame and an outer frame, one of which is rotatable with respect to the other about an axis, a tape guide carried by one of the frames in position to receive tape from the other frame, and means for rotating one of the frames in a direction to wrap tape in overlapping layers on one of the frames when said frames have relative rotation with respect to one another during which tape is accumulated by said accumulator for maintaining a continuous supply of tape to a production unit while one end of the tape is stopped for splicing an additional tape to the trailing end of the tape wound on the accumulator, characterized by tape holding surfaces on both of the frames in position to be wound with spiral reels of tape on both of the frames simultaneously during accumulation, guides over which the tape passes to wrap the tape into the spirals from the inside of the spirals so that the outside diameter of each spiral remains constant during accumulation and the inside diameters of the tape spirals both decrease as more layers of tape are applied to the reels of tape.

* * * * *